US012043904B2

(12) United States Patent
Hoyt et al.

(10) Patent No.: US 12,043,904 B2
(45) Date of Patent: Jul. 23, 2024

(54) AUTOMATED CORROSION MONITORING AND CONTROL SYSTEM FOR MOLTEN SALT EQUIPMENT

(71) Applicant: UCHICAGO ARGONNE, LLC, Chicago, IL (US)

(72) Inventors: Nathaniel C. Hoyt, Clarendon Hills, IL (US); Jicheng Guo, Woodridge, IL (US); Mark A. Williamson, Naperville, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 135 days.

(21) Appl. No.: 16/837,568

(22) Filed: Apr. 1, 2020

(65) Prior Publication Data

US 2021/0310132 A1 Oct. 7, 2021

(51) Int. Cl.
*C23F 13/04* (2006.01)

(52) U.S. Cl.
CPC ..... *C23F 13/04* (2013.01)

(58) Field of Classification Search
CPC ..... C23F 13/04; C23F 13/06; C23F 13/22; C25C 3/02; C25C 3/04
See application file for complete search history.

(56) References Cited

U.S. PATENT DOCUMENTS 1,258,261 A * 3/1918 Seward ..... C25C 3/34 205/405
5,024,737 A * 6/1991 Claus ..... C25C 3/02 205/363
5,665,220 A * 9/1997 Sharma ..... C01D 15/04 205/411
2015/0299868 A1* 10/2015 Sergi ..... C23F 13/20 205/730
2015/0354376 A1* 12/2015 Garosshen ..... C23F 13/08 416/241 R
2017/0294241 A1* 10/2017 Dodson ..... C23F 13/22
2018/0010256 A1* 1/2018 Willit ..... C25D 3/66
2018/0119299 A1* 5/2018 Doughty ..... C25C 3/00
2019/0285565 A1 9/2019 Hoyt et al.
2019/0376192 A1* 12/2019 Ding ..... C25C 7/005

OTHER PUBLICATIONS

Krystal Nanan, "If Copper is a Noble Metal then Why are My Pipes Corroding?", Corrosionpedia, 2018, https://www.corrosionpedia.com/if-copper-is-a-noble-metal-then-why-are-my-pipes-corroding/2/6677 (Year: 2018).*

* cited by examiner

*Primary Examiner* — Luan V Van
*Assistant Examiner* — Mofoluwaso S Jebutu
(74) *Attorney, Agent, or Firm* — CHERSKOV FLAYNIK & GURDA, LLC

(57) ABSTRACT

The invention provides an in situ method for protecting material exposed to molten salt, the method having the steps of supplying metal in a first nonreactive state to the molten salt to create a mixture; measuring a redox state of the mixture; and transforming the metal to a second reactive state when the redox state indicates corrosion of the material is about to occur. Also provided is a system for preventing corrosion of structural alloys in molten salt environments, the system having a vessel defining a void containing the molten salt; a voltammetry sensor inserted into the molten salt; a first cathode inserted into the molten salt; and a first anode inserted into the molten salt, whereby the cathode and anode are in electrical communication with an electrical power source.

17 Claims, 3 Drawing Sheets

AUTOMATED CORROSION MONITORING AND CONTROL SYSTEM FOR MOLTEN SALT EQUIPMENT

CONTRACTUAL ORIGIN OF THE INVENTION

This invention was made with government support under Contract No. DE-AC02-06CH11357 awarded by the United States Department of Energy to UChicago Argonne, LLC, operator of Argonne National Laboratory. The government has certain rights in the invention.

BACKGROUND OF THE INVENTION

1. Field of the Invention

This invention relates to molten salt production scenarios and more specifically this invention relates to a method and system for preventing corrosion of structural parts in molten salt venues while also minimizing danger to operating personnel.

2. Background of the Invention

Molten salts have excellent properties as heat transfer fluids, fuel salts, and as coolants for nuclear-, solar power-, and metals production-applications. However, molten salts aggressively attack structural metals (such as tanks and piping components), which leads to great expense and limited lifetime of the associated equipment. High temperature alloys (e.g., Inconel) suffer from corrosion in molten $MgCl_2KCl$—NaCl, arising from a variety of mechanisms, including impure salt. Corrosion products such as $Fe^{2+}$ and $Cr^{2+}$ have been observed in the aforementioned molten chloride test systems.

Typical corrosion occurs when atmospheric moieties (e.g., gaseous $H_2O$ and $O_2$) enter the salt, such as the aforementioned $MgCl_2KCl$—NaCl. A variety of corrosive impurities and corrosion products (e.g. MgOHCl, HCl, $CrCl_2$) result. These impurities may begin corroding structure materials, such as stainless steel (which contains chromium) via the reactions depicted in Equations 1-3:

$$MgCl_2KCl\text{-}NaCl+H_2O+O_2 \rightarrow MgOHCl+HCl \quad \text{Equation 1}$$

$$MgOHCl \rightarrow MgO+HCl \quad \text{Equation 2}$$

$$Cr^0+2HCl \rightarrow CrCl_2+H_2 \quad \text{Equation 3}$$

wherein the water and oxygen are derived from the ambient atmosphere.

Corrosion concerns often necessitate the incorporation of expensive alloys (e.g., Inconel, Hastelloy, and Haynes superalloy variants, refractory metals, etc.) to create the vessels and piping to contain the molten salt.

A variety of approaches have been employed to prevent corrosion phenomena in molten salt equipment. Beyond the use of the aforementioned expensive corrosion-resistant alloys, the manual addition of quantities of reactive metal (e.g. beryllium metal or uranium metal) into the molten salt has been used to minimize corrosion in molten salt reactors. The manual addition of Mg metal into salts for concentrated solar power (CSP) applications has also been attempted. These approaches require the direct injection or insertion of reactive metals into a molten salt system, thus creating hazardous conditions.

The inserted metals are often pyrophoric in nature and can be acutely toxic. The metal in these instances is therefore often added in large quantities in order to limit the frequency at which the hazardous addition procedures must be performed. The addition of large quantities of these metals however often leads to over-saturated conditions where the reactive metal can exceed its solubility limit within the salt. This leads to the disruptive plating out of metal within the vessel or flow loop.

A need exists in the art for an automated method and system for maintaining molten salt in a non-corrosive state. The method and system should provide in situ production of reactive metal that upon production, removes impurities of the salt that otherwise accumulate during the salt's useful life. The method and system should eliminate personnel hazards associated with repeatedly handling hazardous and reactive metals and inserting same into molten salt baths. The method and system should also comprise resupplying the metal, but in its nonreactive state, within the molten salt. The method and system should provide precise salt potential control but with no moving parts.

SUMMARY OF INVENTION

An object of the invention is to provide a system and method for preventing structural corrosion in molten salt venues that overcomes many of the drawbacks of the prior art.

Another object of the invention is to provide a system and method for preventing corrosion of structures exposed to molten salt. A feature of the invention is the continual presence of reductant in the bath. An advantage is that by measuring salt conditions in real-time, the initiation of corrosion to structural members is prevented instead of simply minimized or stopped.

Still another object of the invention is to provide a safe system and method for operating molten salt processes in heat transfer scenarios, fuel salt applications, and in the cooling of high heat processes such as nuclear power and concentrated solar power (CSP) operations. A feature of the invention is an ever present amount of reactive metal within the salt bath and the constant monitoring of the redox of the bath. An advantage of the invention is that as impurities such as water enter the salt and lead to increasingly oxidized salt chemistry indicative of corrosion conditions, in situ reactive metal is automatically reduced at a cathode upon application of a voltage to the bath. The generation of this reactive metal prevents oxidation of the structural components which are also exposed to the salt bath and salt bath atmosphere.

Yet another object of the invention is to provide cathodic protection of structural alloys exposed to molten salts. A feature of the invention is combining a corrosion monitoring system and an electrolysis system. An advantage of the invention is its generation of precise quantities of in situ reactive metal on demand so as to prevent both the initiation of corrosion of the structural alloys, and the plating of the reactive metal on such alloys.

Briefly, the invention provides a method and system for monitoring salt redox state and composition using electroanalytical techniques. That data determines when an in situ electrolysis procedure is initiated to generate reactive metal for cathodic protection. The reactive metal in turn reduces impurity species out of the salt, protecting structural alloys from corrosion due to oxidative processes.

Specifically, the invention provides an in situ method for protecting material exposed to molten salt, the method comprising supplying metal in a first nonreactive state to the molten salt to create a mixture; measuring a redox state of the mixture; and transforming the metal to a second reactive state when the redox state indicates corrosion of the material is about to occur.

The reactive metal in the first state may be the cation of a salt selected from the group consisting of alkali metals, alkali earth metals, transition metals, lanthanide metals, and actinide metals and combinations thereof. Specifically, the salt may be selected from the group consisting of LiCl, KCl, NaCl, $BeCl_2$, $MgCl_2$, $CaCl_2$), $BaCl_2$, LiF, KF, NaF, $BeF_2$, $MgF_2$, $CaF_2$, $BaF_2$, $ZrCl_4$, $ZrCl_2$, $ZrF_2$, $ZrF_4$, $UCl_3$, $UF_3$, $PuF_3$, and combinations thereof. In an embodiment of the invention, the reactive metal is an alkali or alkaline earth metal selected from the group consisting of Li, K, Na, Be, Mg, Ca, Ba, and alloys thereof.

Also provided is a system for preventing corrosion of structural alloys in molten salt environments, the system comprising a vessel defining a void containing the molten salt; a voltammetry sensor inserted into the molten salt; a first cathode inserted into the molten salt; and a first anode inserted into the molten salt, whereby the cathode and anode are in electrical communication with an electrical power source. The iR-free polarization of the power source is typically less than 5V, but may be as large as 10V depending on specific salt conditions. (iR-free polarization refers to the remaining cell potential when effects from Ohmic losses have been subtracted from the total cell potential.)

BRIEF DESCRIPTION OF DRAWING

The invention together with the above and other objects and advantages will be best understood from the following detailed description of the preferred embodiment of the invention shown in the accompanying drawings, wherein.

DETAILED DESCRIPTION OF THE INVENTION

Figure 1:
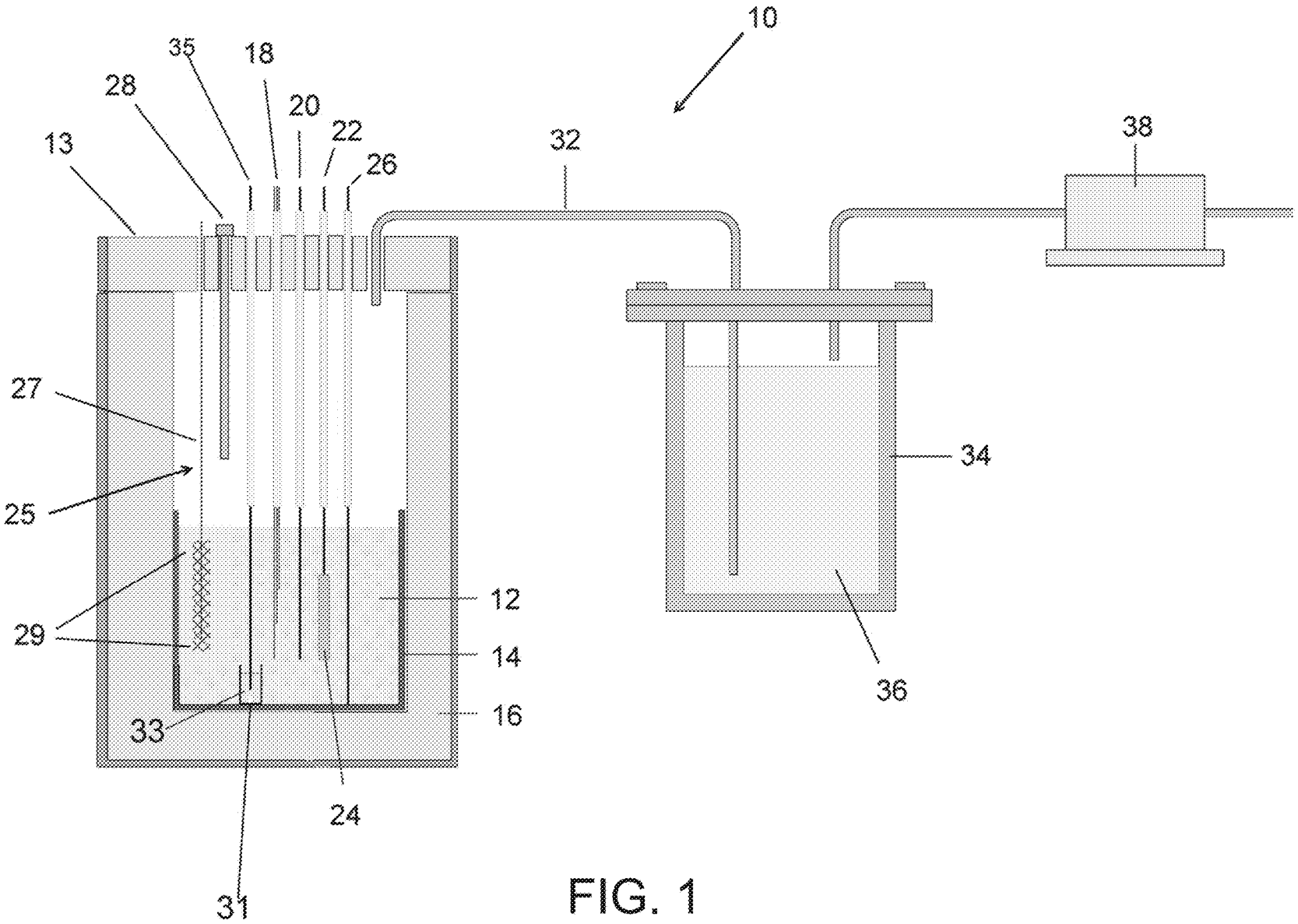
FIG. 1 is a schematic elevational view of a system for protecting componentry in contact with molten salt environs, in accordance with features of the present invention.

The foregoing summary, as well as the following detailed description of certain embodiments of the present invention, will be better understood when read in conjunction with the appended drawings.

All numeric values are herein assumed to be modified by the term "about", whether or not explicitly indicated. The term "about" generally refers to a range of numbers that one of skill in the art would consider equivalent to the recited value (e.g., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

The following detailed description should be read with reference to the drawings in which similar elements in different drawings are numbered the same. The drawings, which are not necessarily to scale, depict illustrative embodiments and are not intended to limit the scope of the invention.

As used herein, an element or step recited in the singular and preceded with the word "a" or "an" should be understood as not excluding plural said elements or steps, unless such exclusion is explicitly stated. As used in this specification and the appended claims, the term "or" is generally employed in its sense including "and/or" unless the content clearly dictates otherwise.

Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The invention comprises a hybrid impressed current cathodic protection (ICCP) technique wherein in situ generation of the sacrificial anodes occurs. Cathodic protection connects the base metal at risk (steel) to a sacrificial metal that corrodes in lieu of the base metal. The technique of providing cathodic protection to stainless steel and other structural alloys preserves the metal by providing a highly active metal that can act as an anode and provide free electrons. By introducing these free electrons, the active metal sacrifices its ions and keeps the less active steel from corroding.

A method and system is provided for facilitating the in situ production of precise quantities of reactive metal within a molten salt vessel, such as a crucible or flow loop. The reactive metal is initially introduced in the molten bath as a salt (e.g., $MgCl_2$), thus representing the metal in a first nonreactive state. Mg (or whatever cation) is then electrodeposited (e.g., transformed) as metal onto a first electrode, thereby forming a sacrificial anode. At this point, the deposited metal is in a second reactive state. The anode is technically considered a cathode during the in situ deposition process. The terms "cathode" and "anode" refer to the direction of current, and inasmuch as the aforementioned electrodeposition of metal is driven by the first electrode donating electrons, that first electrode is considered the cathode during the in situ generation of the sacrificial anode. The "cathode" becomes the anode once the applied current is stopped.

The metal cation is selected to have a lower reduction potential than the material to be protected from corrosion. Such a metal to material redox potential pairing assures automatic sequestration of corrosive anions prior to any material corrosion occurring.

Generally, the molten salt vessel provides a means for preventing fluid exchange between a void defined by the vessel and the ambient environment. For example, a crucible may provide a cap or other enclosure to prevent fluid exchange. Fluid exchange between a conduit and its surroundings is inherent given the nature of the conduit when fluid is relegated to inside the conduit.

The invention combines a multifunctional voltammetry sensor with an electrolysis system to generate reactive metal at its cathode by passage of electrical current. By simultaneously monitoring the salt potential (i.e., the salt redox state) and impurity concentration using the voltammetry sensor, the propensity for salt corrosion to occur can be assessed prior to corrosion actually occurring. Maintaining a low salt potential is crucial to prevent corrosion of structural alloys.

Monitoring of corrosion products is facilitated via application of voltammetry methods. These methods may include linear sweep voltammetry, normal pulse voltammetry, square wave voltammetry, and other voltammetric approaches. Potentiometric and chronoamperometric methods may also be employed. For these techniques, specific voltage or current waveforms are applied to electrodes immersed in the salt. The corresponding response to the applied signal can then be analyzed using analytical formulas to determine characteristics of the salt. For example, the Berzins-Delahey Equation maybe utilized, to wit:

$$i_p = 0.61AC_i\sqrt{\frac{n^3F^3D_i\nu}{RT}}$$

Wherein $i_p$ is the peak current, A is the electrode area, $C_i$ is the species concentration, n is the number of electrons associated with the reaction, F is Faradays' constant, $D_i$ is the diffusion coefficient of the species of interest, ν is the scan rate of the linear sweep, R is the gas constant, and Tis the temperature. Alternatively, digital simulations may be used instead of analytical formulas for cases where the voltammetric response includes non-ideal effects, such as reversible kinetics or Ohmic effects.

Monitoring of the salt potential may be performed by either a traditional thermodynamic reference electrode, or by a dynamic reference electrode that is built into the multifunctional voltammetry sensor. The dynamic reference electrode makes use of cathodic potential sweeps to determine the salt potential relative to the known potentials associated with the principal salt constituents.

Before conditions within the melt deteriorate to the point where corrosion of structural materials occur, the combined electrolysis system is activated to generate a precise amount of reactive metal-enough to reduce the salt impurities and prevent corrosion, but not enough to exceed saturation conditions and plate out a damaging layer onto the molten salt-exposed equipment.

An embodiment of the system comprises a voltammetry sensor to monitor the salt. Voltammetry techniques include linear sweep voltammetry (LSV) which is used to measure a variety of species, including corrosion products (e.g. $Cr^{2+}$, $Fe^{2+}$) and corrosion impurities (e.g., $O^{2-}$, MgOHCl). Suitable voltammetry sensors contain a plurality of electrodes to provide multifunctional measurements for a variety of molten salt applications. The sensors are capable of accurately measuring the species in molten salts for long durations (e.g., more than 19 months continuous immersion). The sensors additionally have capabilities for salt potential measurements using quasi- and dynamic-reference electrode measuring approaches. As such, the invention embodies a combination of a quasi- and dynamic-reference electrode used to measure salt redox potential. An exemplary sensor is a Multielectrode Sensor for Concentration and Depth Measurements described in U.S. patent application Ser. No. 15/923,155, published on Sep. 19, 2019, the entirety of which is incorporated herein by reference.

The sensor is combined with an electrolysis cell for in situ generation of reactive metal. A multichannel potentiostat controls the voltammetry sensor, which in turn activates a power supply or another potentiostat to perform the electrolysis procedure.

During electrolysis, reactive metal is deposited at the cathode while a halide gas (e.g., $Cl_2$ or $F_2$, depending on the salt) or other reaction product is generated at the anode. During the in situ generation process, the cathode is disconnected from the structural metal of the loop to prevent deposition of the reactive metal in undesired locations. Upon completion of the generation, the cathode may be reconnected to the loop using an electrical bridge such as a relay or switching mechanism. Alternatively, or in addition, the cathode may be electrically connected to an auxiliary high surface area electrode or electrodes immersed in the salt. The electrical bridge is adapted to be actuated when reactive metal is available on the sacrificial anode to provide corrosion protection.

If desired, the cathode may be left disconnected from the loop in order to consume impurities through thermodynamic pathways instead of electrochemical pathways. Either way, the reactive metal then combines with impurities in an amount to keep the impurities below a corrosion activation concentration. Equation 4 below depicts an exemplary reaction sequence.

$$Mg^0+2HCl \rightarrow MgCl_2+H_2 \qquad \text{Equation 4}$$

Generated gas is removed from the molten salt loop or vessel and consumed in an appropriate scrubber cell. Removal of the gas provides a means for preventing the gas from back-reacting with the generated metal at the cathode and hampering the intended corrosion prevent capabilities. Removal of the halide gas is facilitated by an inert cover gas system that directs the gas into a scrubber system. Inside the scrubber system, the halide gas is consumed in a reaction with a suitable sacrificial metal (e.g., high surface area copper or iron). Occasional replacement of the consumed sacrificial metal allows the corrosion prevention system to be run for indefinitely long periods of time.

FIG. 1 is a schematic diagram of the invented corrosion prevention system, the system generally designated as numeral 10. Molten salt 12 is contained within a crucible or other heat tolerant container 14. In turn, the container is encapsulated or otherwise encircled by a furnace 16. One means for encapsulating the container is with a cap 13 such that fluid exchange between the void created by the container (i.e., the head space) and the ambient atmosphere is prevented. The cap may mate with the furnace in a male-female treaded configuration, snap-fit, or some other configuration. If the salt-containing vessel 14 is sequestered or otherwise positioned within a controlled-atmosphere environment, then the salt may be open to the controlled atmosphere.

Alternatively, the aforementioned molten salt encapsulation paradigm may be replaced with a fully enclosed molten salt loop (which may be defined by a conduit or a series of conduits, pipes tubes or other structures), which allows for molten salt sequestration and flow while the molten salt is not in fluid communication with the ambient environment.

A voltammetry sensor 18 is immersed into the salt 12 to measure the salt redox state and composition. The voltammetry sensor 18 may share a common counter electrode 20 (e.g., anode) with the electrolysis system, or it may be in electric communication with its own independent counter electrode. The working electrode 22 of the electrolysis system is also immersed into the salt 12, and serves as the cathode for the reactive metal deposit 24 gathering at the cathode surface. The working electrode may be a solid cathode or a liquid cathode. An auxiliary electrode 26 allows for connection of the reactive metal cathode 12 to the crucible 14 to provide additional cathodic protection. This is an optional connection and can be provided either by relays, switches, or by a potentiostat operating in a zero resistance amperometry (ZRA) mode.

The cathode may consist of either a solid structure onto which the reactive metal is electrodeposited, or it may consist of a liquid metal into which the reactive metal is electrodeposited. The metal deposited onto the solid cathode will have a unit activity as it is deposited as a pure metal.

The use of the liquid metal cathode allows for greater control of the salt potential by allowing a wide range of activities for the sacrificial anode, instead of the aforementioned unit activity deposit that is achieved at a solid cathode. The liquid metal cathode comprises an electrically-isolated container (element 31 in FIG. 1) sequestering or otherwise confining a quantity of noble liquid metal 33 (e.g. lead, bismuth, cadmium, etc.) immersed in the molten salt. The container 31 may define solid sides and a solid bottom, wherein the bottom is supported by an upwardly facing surface of the bottom of the salt containing vessel 14.

The container 31 is shown further comprising an open top so as to define a periphery. Below a plane formed by the periphery may reside the surface of the liquid metal 33, in which a liquid cathode electrode lead 35 is immersed. However, the container may define a closed top, the top defining a region forming an aperture. The aperture may have a cross diameter slightly larger than the cross diameter of the lead so as to slidably receive or otherwise allow access of the lead to interior regions formed by the closed top container 31.

It should be pointed out that the container may be electrically isolated inasmuch as electrons are not necessarily in contact with it, sans an applied voltage. So, while the electrode in the salt is in ionic contact with the system, that does not mean it is in electronic contact with anything. Ions can travel in the salt but electrons cannot.

Preferably both the solid and liquid cathodes are electronically isolated. The reactive metal from the salt is electrodeposited into the liquid metal during the electrolysis procedure, thereby generating a liquid metal alloy.

As such, transformation may occur at a solid or liquid metal cathode, or a combination solid/liquid cathode immersed within the molten salt.

As the reactive metal is deposited into the liquid metal, its activity will be a function of its concentration in the resulting liquid metal alloy. The exact activity of the liquid metal cathode can be controlled by maintaining a specific ratio of the deposited reactive metal relative to the noble liquid metal in the liquid metal alloy. The ability to have a sacrificial anode with controllable activity allows for direct electrical connection of the anode to the loop structure without the risk of unwanted deposition of reactive metal onto the structural metal.

An alternative auxiliary high-surface area electrode (or electrodes) 25 may also provide an optional connection to the solid cathode or liquid cathode after reactive metal has been deposited onto it. The reactive metal cathode 22 can be connected to this high surface area electrode 25 instead of to the vessel wall to allow for electrochemically-assisted reduction of impurities to occur there instead of on the structural metal of the vessel or loop. Connection of the reactive metal to this high surface area electrode 25 instead of to the loop/crucible via auxiliary electrode 26 allows for accelerated reduction of impurities in the salt without the risk of unintended plating of metal onto the loop structure. When the reactive metal cathode is connected in such a manner, it acts as a sacrificial anode. Whenever the reactive metal on this electrode is consumed, the high-surface area electrode can be disconnected and electrolysis can again be initiated to regenerate reactive metal solely on the cathode.

The high surface area electrode 25 may comprise a lead 27 terminating in a metal mesh, perforated metal sheet, metal wool, metal brush, or other high surface-area configuration 29. The high surface area electrode may be made of a material such as nickel, stainless steel, transition metal, refractory metals, and combinations thereof.

An inert gas inlet 28 allows for ingress of cover gas to sweep halide gas (electrolytically generated at the anode 20) from the furnace 16. The halide gas is swept out of the furnace via a gas egress means 30, that egress means in fluid communication with a scrubber system 34 situated external of the furnace 16. A conduit, pipe or other elongated enclosure 32 adapted to receive gas or liquid phase material provides a means for transporting the halide gas from the furnace 16 to the scrubber system 34.

The halide gas and cover gas are pumped into the scrubber system 34 where reactions between the halide gas and a consumable high-surface-area metal 36 such as copper or iron occur.

A means to evacuate carrier gas and halide gas from the reaction chamber may be employed. For example, positive pressure carrier gas imposed upstream may be utilized. Alternatively, a pump 38 situated downstream of the furnace and scrubber 36 facilitates gas flow with the imposition of negative pressure on the system. Multiple gas-generation anodes also may be employed to facilitate gas evolution (such as halide gas evolution, or for deoxygenation), depending on salt conditions. The anodes may be specific for removing specific salt impurities. These anodes may be inert or consumable depending on the specific impurity. The anode may be based on oxide, refractive metal, liquid metal, platinum group metal, or any transition metals. For example, inert anodes may be used to remove $O_2$ or halide gas from the salt. Alternatively, non-inert anodes (e.g. graphite) may be used to remove $O_2$ via a participating reaction (e.g. the creation of CO, $CO_2$, etc.).

In operation, the invented monitoring and control combination utilizes a sequence of measurements taken on the voltammetry sensor. These measurements indicate the appropriate time for electrolysis to begin. An exemplary sequence comprises a variety of electroanalytical procedures from which information regarding the salt redox state can be assessed. The gathered data may include salt potential, the compositions of corrosion products in the salt, the centration of impurities in the salt, and the concentration of soluble corrosion-prevention species (such as soluble Mg) within the salt.

An assessment regarding the propensity for corrosion of the structural alloys is then made. This assessment is based on the information generated by the voltammetry sensor in combination with information taken from corrosion studies of the alloys of interest. Once the assessment is made that unfavorable conditions are beginning to develop within the salt, the electrolysis system is activated for a time to generate a stoichiometric amount of corrosion inhibiting reactive metal.

Upon activation of the electrolysis current, the positive or negative pressure inducement is initiated to remove the generated halide gas (e.g., chlorine or fluorine gas) from the anode. This provides a means for maintaining the salt in a non-corrosive state for extended periods of time. The rate at which the system is activated is dictated by the voltammetry sensor system such that the combined system can respond to off-normal conditions (e.g. air leaks) by activating the electrolysis cell at an accelerated rate.

EXAMPLE

Figure 2:
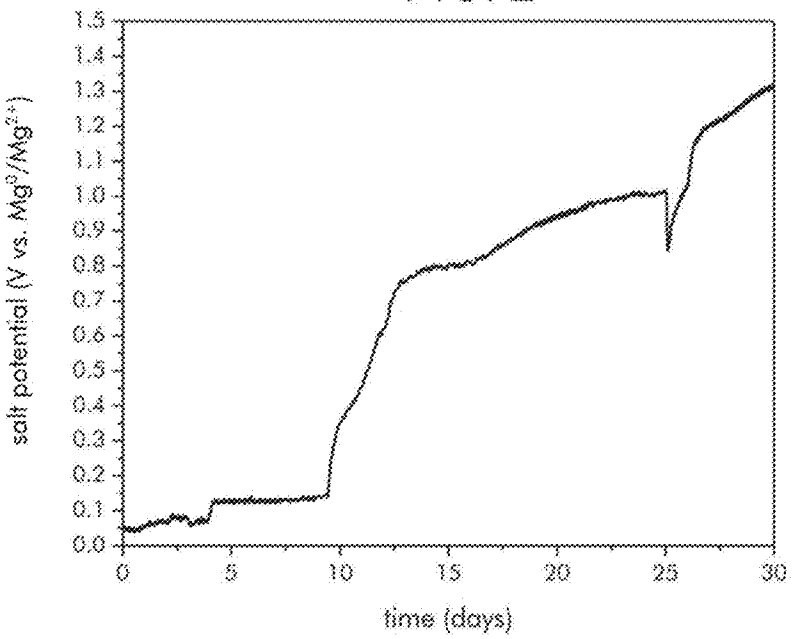
FIG. 2 is a graph showing uncontrolled generation of impurities in a molten salt bath.

Results from demonstration experiments are shown in FIGS. 2 and 3 and performed in controlled atmospheres, such as those conferred by a glovebox.

Molten Salt aliquots were positioned within a molten salt crucible at a temperature selected to maintain the aliquots in a liquid phase. So for example, if $MgCl_2$—KCl—NaCl salts are used, heat would be applied to cause the aliquots to be maintained in liquid phase at approximately 550° C.

Impurities above the molten salt (e.g., gaseous H2O and O2 at low ppm) were able to enter the salt, slowly creating a variety of corrosive impurities. Again, if $MgCl_2$—KCl—NaCl are used, those impurities would include MgOHCl, HCl, etc. These impurities have the tendency to oxidize the crucible material (e.g., chromium-containing Inconel) and raise the salt potential.

Magnesium metal can effectively reduce salt impurities, thereby lowering the salt redox potential. Solid Mg metal was used to purity the salt prior to entering the loop.

The voltammetry sensor is applied to monitor the salt potential. The automated electrolysis system is integrated into the molten salt system to produce Mg in situ. Once the salt potential is higher than a pre-determined value, Mg is produced electrochemically to lower the salt potential.

Electrochemically produced Mg effectively reduced the salt potential. The cell atmosphere was adjusted to simulate off-normal conditions in CSP loops. The corrosion control system responded to the change by adjusting the electrolysis frequency. No corrosion products were observed from the electroanalytical measurements taken throughout the test.

FIG. 2 is a graph showing the salt potential rising. An initial quantity of Mg metal was present and able to maintain a low potential for the first 10 days of the experiment. In fact, the initial potential during the experiment (<100 mV vs. $Mg^0/Mg^{2+}$) is indicative of oversaturation of reactive metal in the salt.

However, after the initial quantity of Mg was oxidized during the course of its exposure in the molten bath, the potential in the bath increases (particularly after day 15) such that unwanted oxidation (i.e., corrosion) of the alloy components can occur. Thus, FIG. 2 shows results of an uncontrolled experiment whereby the salt was out of the idea range for the majority of the experiment. Corrosion products were eventually detected in large quantities (e.g., greater than 1000 ppm) in the salt. The level of corrosion observed would have led to destruction of the crucible if allowed to continue unabated.

Figure 3A:
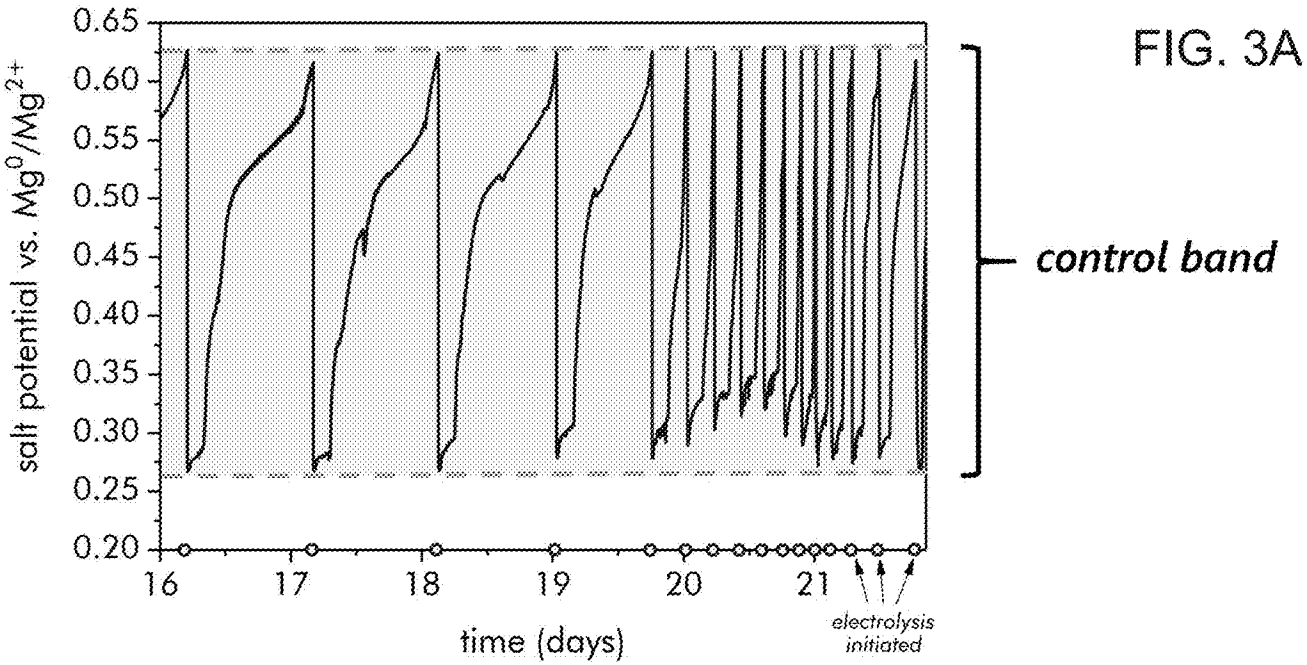
FIG. 3A is a graph showing electrolysis-controlled salt bath potential, in accordance with features of the present invention.

FIG. 3A depicts a graph showing results when electrolysis is activated to prevent corrosion in a salt bath. This graph shows the salt potential successfully maintained between (0.25 V and 0.625 V vs $Mg^0/Mg^{2+}$ when $MgCl_2$—KCl—NaCl salt was utilized) for more than 21 days. The 0.65 V upper limit was selected such that the equilibrium concentration of $Cr^{2+}$ in the salt is maintained well below 1 ppm. Alternate upper potential limits may be selected depending on the desired maximum concentration for $Cr^{2+}$ or other corrosion products. Maintaining the $Cr^{2+}$ concentration well below 1 ppm essentially prevents observable corrosion. The equilibrium concentration of $Cr^{2+}$ in the salt is controlled by the salt potential, as described by the Nernst equation (Eq. 5). Maintaining the salt potential as low as possible leads to lower $Cr^{2+}$ concentrations and low corrosion rates.

$$E=RT/zF\ In(a_{Cr^2+}/a_{Cr^0}) \qquad \text{Equation 5}$$

For a molten halide salt, $Cr^0/Cr^{2+}$ is usually around +1.1 V, so 0.625 V is well below that. At 0.625 V the equilibrium concentration of $Cr^{2+}$ in the salt is well under 1 ppm, which serves to limit corrosion. If the potential were higher, 1000's of ppm of $Cr^{2+}$ could enter the salt causing major corrosion.

The 0.25 V potential was low enough to prevent oxidation of the structural metal but not so low as to cause oversaturation within the bath that would lead to plating out.

The positions 50 of the automatically initiated electrolysis sequences are indicated on the time axis (i.e. the abscissa) and directly correspond to where the salt potential rapidly drops.

Air ingression tests were performed to demonstrate the ability of the sensor to indicate off-normal conditions. Changes in the salt potential were immediately detected as impurities entered the salt. Increased corrosion rates could be calculated from the measurements and were highly correlated to the condition of the atmosphere.

Figure 3B:
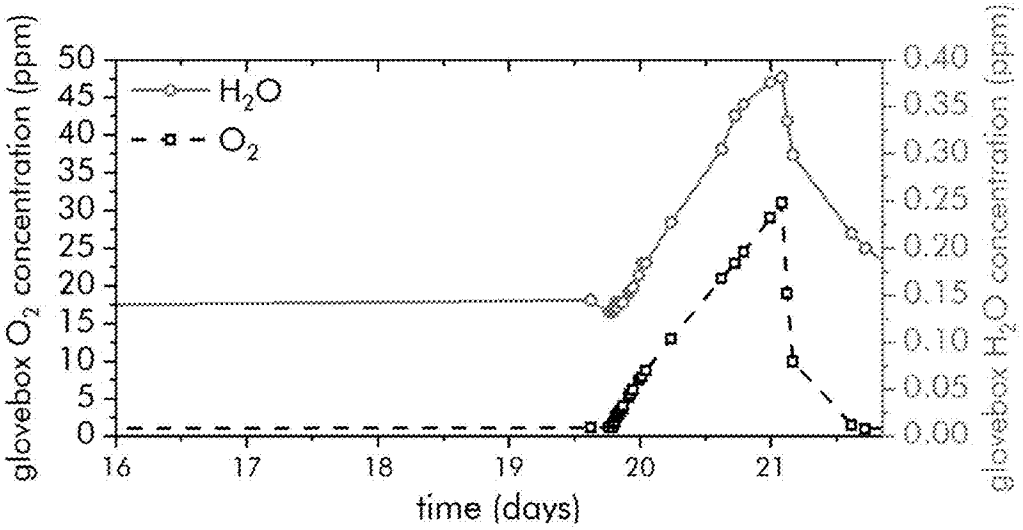
FIG. 3B is a graph showing the imposed water incursion that was applied to the salt bath.

FIG. 3B is a graph showing air ingression testing. It depicts the imposed water incursion that was applied to the salt bath. This incursion was imposed by applying water and oxygen with the indicated concentrations to the atmosphere above the salt. This involved disabling the glovebox's air purification system on Day 20 to allow extra amounts of $O_2$ and $H_2O$ into the salt. In all instances, the control system responded positively and in direct proportion to the rate of impurities entering the salt, such that the electrolysis system was activated more often. At no point during the test were $Cr^{2+}$ or other metal corrosion products detected in the salt. This indicated the effectiveness of the in situ Mg production approach.

In summary, the invented system and method eliminates the need for direct user intervention and direct handling of dangerous reactive metals (e.g., Be or Mg). Rather, the in situ generation of metal ensure that the users/operator will not be exposed to these type of safety hazards, nor will the loop be exposed to possible unwanted air incursions. The invention's feature of automatically generating the metal allows for producing the precise amount of reactive metal to prevent corrosion but not so much as to deposit onto exposed metal surfaces and cause degradation of valves and other sensitive components in fluid communication with the melt. The invention displays novel capabilities for facilitating the unattended control and monitoring of the corrosion of molten salt equipment.

Commercial applications include molten salt reactors, nuclear reprocessing (e.g., oxide reduction and electrorefining), CSP systems, and metals production. For example, state of the art molten salt CSP systems utilized nitrate salts (e.g., $NaNO_3$—$KNO_3$) at temperatures of about 500° C. Next generation molten salt systems will use chloride salt (e.g., $MgCl_2$—KCl—NaCl) at relatively higher operating temperatures (about 700° C.) to realize potentially lower costs.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. An automated method for protecting material exposed to molten salt, the method comprising:

a. supplying a first metal in a first nonreactive state to the molten salt, which is residing in a vessel to create a mixture;

b. monitoring a redox state of the mixture; and c. using a noble liquid metal cathode which is confined to an electrically isolated container within the vessel, to transform the first metal in situ to a second reactive state when the redox state indicates corrosion of the material is about to occur, wherein the metal in the second reactive state combines with the noble liquid metal in specific ratios to provide specific reduction potentials of the noble liquid metal cathode.

2. The method as recited in claim 1 wherein the second reactive state of the first metal reduces impurity species out of the molten salt.

3. The method as recited in claim 1 wherein the transforming step is initiated by electrolysis that generates a liquid metal alloy and gaseous products.

4. The method as recited in claim 1 wherein the redox state is measured by monitoring salt potential and salt composition using a dynamic reference electrode built into a voltammetry sensor combined with an electrolysis cell to maintain the specific reduction potentials within a prescribed range.

5. The method as recited in claim 3 wherein the generated liquid metal alloy has a lower reduction potential than the material.

6. The method as recited in claim 1 wherein the material and the molten salt are in constant physical contact.

7. The method as recited in claim 1 wherein the method is made continuous with supplying additional metal in the first nonreactive state into the molten salt.

8. The method as recited in claim 1 wherein the method is conducted at temperatures from 200° ° C. to 1500° C.

9. The method as recited in claim 3 wherein transformation occurs at the noble liquid metal cathode immersed within the molten salt.

10. The method as recited in claim 4 wherein the voltammetry sensor initiates electrolysis to transform the first metal in the first nonreactive state to the second reactive state at the noble liquid metal cathode immersed within the molten salt.

11. The method as recited in claim 1 wherein the reactive first metal in the first nonreactive state is the cation of a salt selected from the group consisting of alkali metals, alkali earth metals, transition metals, lanthanide metals, actinide metals, and combinations thereof.

12. The method as recited in claim 1 wherein the first metal in the first nonreactive state is the cation of a salt selected from the group consisting of LiCl, KCl, NaCl, $BeCl_2$, $MgCl_2$, $CaCl_2$, $BaCl_2$, LiF, KF, NaF, $BeF_2$, $MgF_2$, $CaF_2$, $BaF_2$, $ZrCl_4$, $ZrCl_2$, $ZrF_2$, $ZrF_4$, $UCl_3$, $UF_3$, $PuF_3$, and combinations thereof.

13. The method as recited in claim 1 wherein the first metal in the second nonreactive state is a metal selected from the group consisting of Li, K, Na, Be, Mg, Ca, Ba, and alloys thereof.

14. The method as recited in claim 3 wherein the gaseous products are immediately treated with the first metal in the second reactive state to form an inert product.

15. The method as recited in claim 1 wherein the liquid cathode is electrically isolated from, but in ionic contact with the molten salt when the redox state of the mixture is measured, wherein the electrical isolation is reversible via an electrical bridge.

16. The method as recited in claim 2 wherein the metal in the second reactive state is generated within the container in stoichiometric amounts relative to the impurity species.

17. The method as recited in claim 16 wherein he second reactive metal is confined to the container but in electrical communication with structural metals residing in the molten salt bath to precisely prevent corrosion of the structural metals.

* * * * *